US010544014B2

(12) United States Patent
Niu et al.

(10) Patent No.: US 10,544,014 B2
(45) Date of Patent: Jan. 28, 2020

(54) METHOD FOR HOISTING AND TRANSPORTING ASSEMBLIES IN UNDERGROUND NUCLEAR POWER PLANT

(71) Applicant: CHANGJIANG SURVEY PLANNING DESIGN AND RESEARCH CO., LTD., Wuhan (CN)

(72) Inventors: Xinqiang Niu, Wuhan (CN); Qigui Yang, Wuhan (CN); Feng Li, Wuhan (CN); Lijun Su, Wuhan (CN); Xuehong Yang, Wuhan (CN); Xin Zhao, Wuhan (CN); Xia Hua, Wuhan (CN); Shudong Wang, Wuhan (CN); Fuzhen Ding, Wuhan (CN); Fei Yu, Wuhan (CN); Yi Su, Wuhan (CN); Guoqiang Zhang, Wuhan (CN); Shiyu Xie, Wuhan (CN); Tao Zhang, Wuhan (CN)

(73) Assignee: CHANGJIANG SURVEY PLANNING DESIGN AND RESEARCH CO., LTD., Wuhan (CN)

( * ) Notice: Subject to any disclaimer, the term of this patent is extended or adjusted under 35 U.S.C. 154(b) by 618 days.

(21) Appl. No.: 15/376,586

(22) Filed: Dec. 12, 2016

(65) Prior Publication Data

US 2018/0002144 A1 Jan. 4, 2018

Related U.S. Application Data

(63) Continuation-in-part of application No. PCT/CN2015/079881, filed on May 27, 2015.

(30) Foreign Application Priority Data

Jun. 13, 2014 (CN) ..... 2014 1 0264483

(51) Int. Cl.
*B66C 19/02* (2006.01)
*E04G 21/00* (2006.01)
(Continued)

(52) U.S. Cl.
CPC ..... *B66C 19/02* (2013.01); *E04G 21/00* (2013.01); *B66C 17/00* (2013.01); *B66C 2700/01* (2013.01); *G21C 19/02* (2013.01)

(58) Field of Classification Search
CPC ..... B66C 19/02; B66C 17/00; B66C 2700/01; E04G 21/00; G21C 19/02; E21D 11/10
See application file for complete search history.

(56) References Cited

U.S. PATENT DOCUMENTS 4,181,231 A * 1/1980 Morrissey, Jr. ..... B66C 11/16 104/137
2014/0161217 A1* 6/2014 Rump ..... G21D 1/00 376/273

FOREIGN PATENT DOCUMENTS

CN 202899128 U * 4/2013
JP 4150063 B1 * 9/2008 ..... E21D 11/10

* cited by examiner

*Primary Examiner* — Lily C Garner
(74) *Attorney, Agent, or Firm* — Matthias Scholl P.C.; Matthias Scholl

(57) ABSTRACT

A method for hoisting and transporting assemblies in an underground nuclear power plant, the method including: 1) pouring concrete onto a reactor cavern to form a rock anchor beam; hoisting a circular bridge crane to the reactor cavern through a hoist shaft on a top of the reactor cavern; mounting the circular bridge crane on the rock anchor beam by using a truck crane; 2) installing a containment cylinder and a track beam of a polar crane in the reactor cavern using the circular bridge crane; hoisting a gantry crane on one end of a polar crane girder and sending the polar crane girder to the reactor cavern; hoisting the other end of the polar crane
(Continued)

girder using the circular bridge crane; allowing the polar crane girder to be horizontal; and mounting the polar crane girder on the track beam.

13 Claims, 4 Drawing Sheets

(51) Int. Cl.
*B66C 17/00* (2006.01)
*G21C 19/02* (2006.01)

METHOD FOR HOISTING AND TRANSPORTING ASSEMBLIES IN UNDERGROUND NUCLEAR POWER PLANT

CROSS-REFERENCE TO RELATED APPLICATIONS

This application is a continuation-in-part of International Patent Application No. PCT/CN2015/079881 with an international filing date of May 27, 2015, designating the United States, and further claims foreign priority benefits to Chinese Patent Application No. 201410264483.6 filed Jun. 13, 2014. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The invention relates to a method for hoisting and transporting assemblies in an underground nuclear power plant.

Description of the Related Art

Typically, underground nuclear power plants include a plurality of caverns serving different purposes. In general, the caverns are irregularly distributed and occupy a relatively large amount of underground space. This leads to inefficiency because the underground passages connecting the caverns are too narrow to conveniently transport large-size facilities and assemblies.

SUMMARY OF THE INVENTION

In view of the above-described problems, it is one objective of the invention to provide a method for hoisting and transporting assemblies in an underground nuclear power plant that is well-organized and efficient.

To achieve the above objective, in accordance with one embodiment of the invention, there is provided a method for hoisting and transporting assemblies in an underground nuclear power plant, the method comprising:

1) pouring concrete onto a reactor cavern to form a rock anchor beam; hoisting a circular bridge crane to the reactor cavern through a hoist shaft on a top of the reactor cavern; mounting the circular bridge crane on the rock anchor beam by using a truck crane;
2) installing a containment cylinder and a track beam of a polar crane in the reactor cavern using the circular bridge crane; hoisting a gantry crane on one end of a polar crane girder and sending the polar crane girder through the hoist shaft to the reactor cavern; hoisting the other end of the polar crane girder using the circular bridge crane; allowing the polar crane girder to be horizontal under a combined effect of the gantry crane and the circular bridge crane; and mounting the polar crane girder on the track beam;
3) employing the track beam and the polar crane girder as supporting points of an assembly jig of a steel lining on a containment dome, and hoisting processed pieces of the steel lining to the reactor cavern through the hoist shaft; soldering and assembling the pieces on the assembly jig;
4) transporting permanent equipment from a nuclear reactor to the containment cylinder through a transport corridor which is connected to the reactor cavern; turning over the permanent equipment and hoisting the permanent equipment to working areas using the polar crane girder.

In a class of this embodiment, when performing 1), a combined cavern is excavated and following steps are performed: mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, when performing 2), a combined cavern is excavated and following steps are performed: mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, when performing 3), a combined cavern is excavated and following steps are performed: mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, when performing 4), a combined cavern is excavated and following steps are performed: mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, when performing 1), 2), 3), and 4), a combined cavern is excavated and following steps are performed: mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, the method comprises: 5) excavating a combined cavern, mounting bridge cranes on a corbel which is disposed lengthwise on an upper part of the combined cavern by the truck crane; transporting nuclear power auxiliary devices through a primary traffic tunnel to an installation platform which is disposed at one side or one end of the combined cavern; and hoisting the nuclear power auxiliary devices to working positions by the bridge cranes.

In a class of this embodiment, the combined cavern comprises an auxiliary powerhouse cavern, the two safe powerhouse caverns, and a nuclear fuel powerhouse cavern. The auxiliary powerhouse cavern, the two safe powerhouse caverns, and the nuclear fuel powerhouse cavern are disposed lengthwise in a line. The auxiliary powerhouse cavern, a first safe powerhouse cavern, the nuclear fuel powerhouse cavern, and a second safe powerhouse cavern are connected in that order. The auxiliary powerhouse cavern, the two safe powerhouse caverns, and the nuclear fuel powerhouse cavern each are connected to the primary traffic tunnel. An outer end surface of the auxiliary powerhouse cavern and one side of the nuclear fuel powerhouse cavern each are provided with an installation platform, and each of the installation platform is connected to the primary traffic tunnel.

Advantage of the method for hoisting and transporting assemblies according to embodiments of the invention is that: the method is convenient and practicable, and the difficulty of hoisting and transporting large-scale assemblies in an underground nuclear power plant is solved.

BRIEF DESCRIPTION OF THE DRAWINGS

The invention is described hereinbelow with reference to the accompanying drawings, in which.

DETAILED DESCRIPTION OF THE EMBODIMENTS

Figure 1:
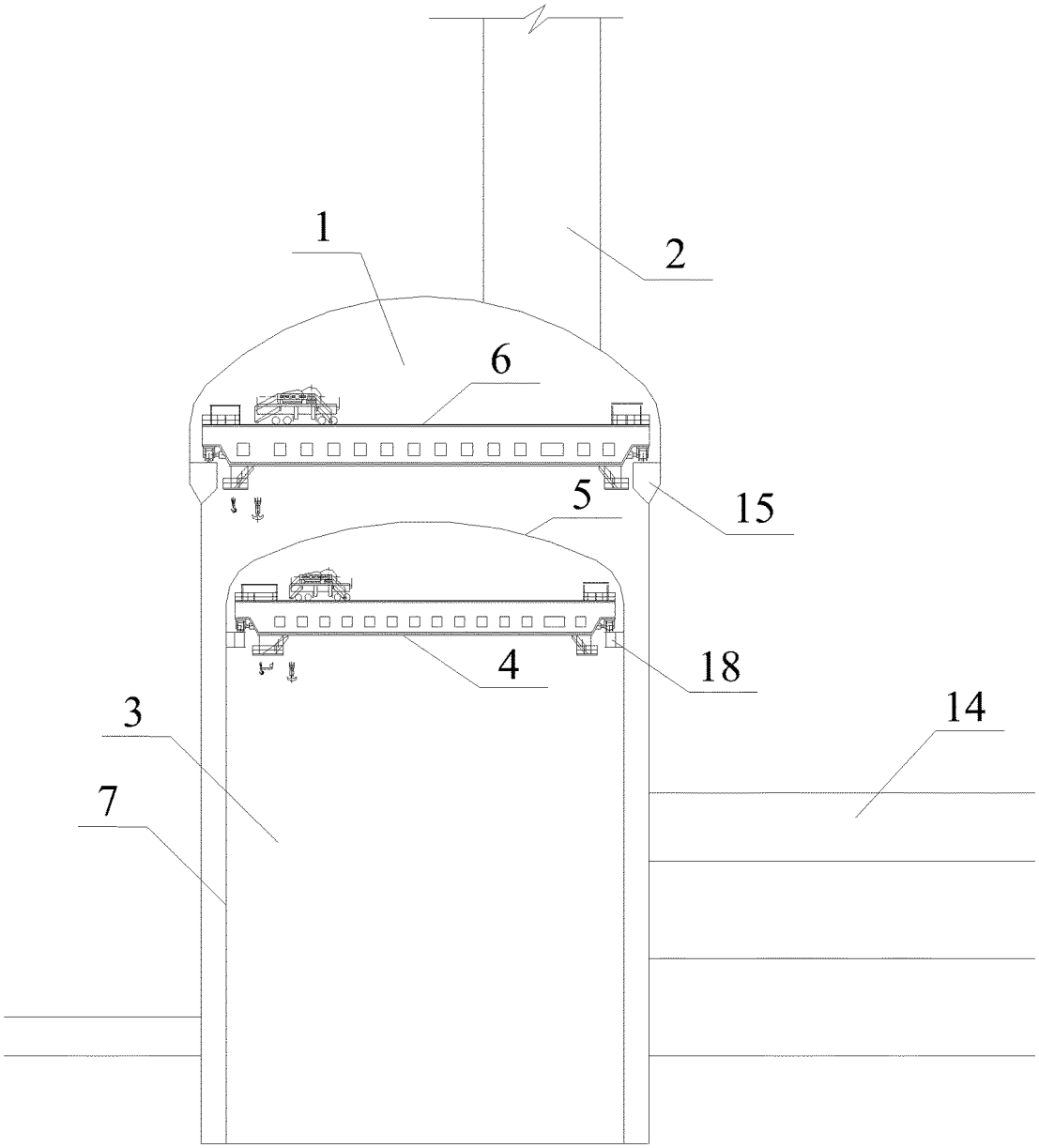
FIG. 1 is schematic diagram showing that large-scale assemblies in a reactor cavern are hoisted and transported using a method for hoisting and transporting assemblies in an underground nuclear power plant in accordance with one embodiment of the invention.

For further illustrating the invention, experiments detailing a method for hoisting and transporting assemblies in an underground nuclear power plant are described below. It should be noted that the following examples are intended to describe and not to limit the invention.

As shown in FIGS. 1-4, the layout of an underground nuclear power plant based on a method for hoisting and transporting assemblies, comprises a reactor cavern 1, a hoist shaft 2, a nuclear reactor 3, a polar crane girder 4, a gantry crane (not shown), a steel lining 5 on a containment dome, a circular bridge crane 6, a truck crane (not shown), a containment cylinder 7, a combined cavern, an installation platform 11, bridge cranes 12, a primary traffic tunnel 13, a transport corridor 14, a rock anchor beam 15, and a track beam 18 of a polar crane.

Figure 3:
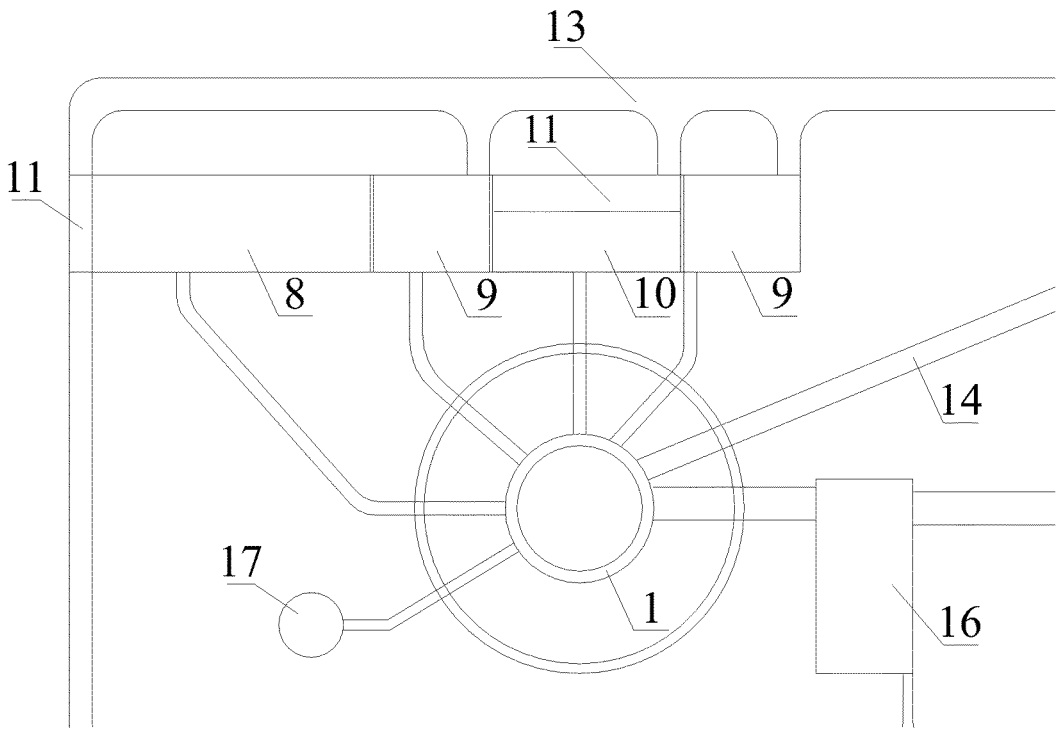
FIG. 3 is a schematic diagram showing a layout in an underground nuclear power plant based on a method for hoisting and transporting assemblies in the underground nuclear power plant in accordance with one embodiment of the invention.

As shown in FIG. 3, the combined cavern is disposed along a depth direction of mountain. The reactor cavern 1 is disposed on one side of the combined cavern, and the primary traffic tunnel 13 is disposed on the other side of the combined cavern. An electric powerhouse cavern 16 and a pressure relief cavern 17 are disposed on the opposite sides of the reactor cavern 1, and the opposite sides are perpendicular to the depth direction of mountain. The electric powerhouse cavern 16 is perpendicular to the depth direction of mountain.

The combined cavern comprises an auxiliary powerhouse cavern 8, two safe powerhouse caverns 9, and a nuclear fuel powerhouse cavern 10. The auxiliary powerhouse cavern, the two safe powerhouse caverns, and the nuclear fuel powerhouse cavern are disposed lengthwise in a line. The auxiliary powerhouse cavern 8, one safe powerhouse cavern 9, the nuclear fuel powerhouse cavern 10, and the other safe powerhouse cavern 9 are connected in that order. The auxiliary powerhouse cavern 8, two safe powerhouse caverns 9, and the nuclear fuel powerhouse cavern 10 each are connected to the primary traffic tunnel 13. An outer end surface of the auxiliary powerhouse cavern 8 and one side of the nuclear fuel powerhouse cavern 10 each are provided with the installation platform 11, and each of the installation platform is connected to the primary traffic tunnel 13.

Figure 4:
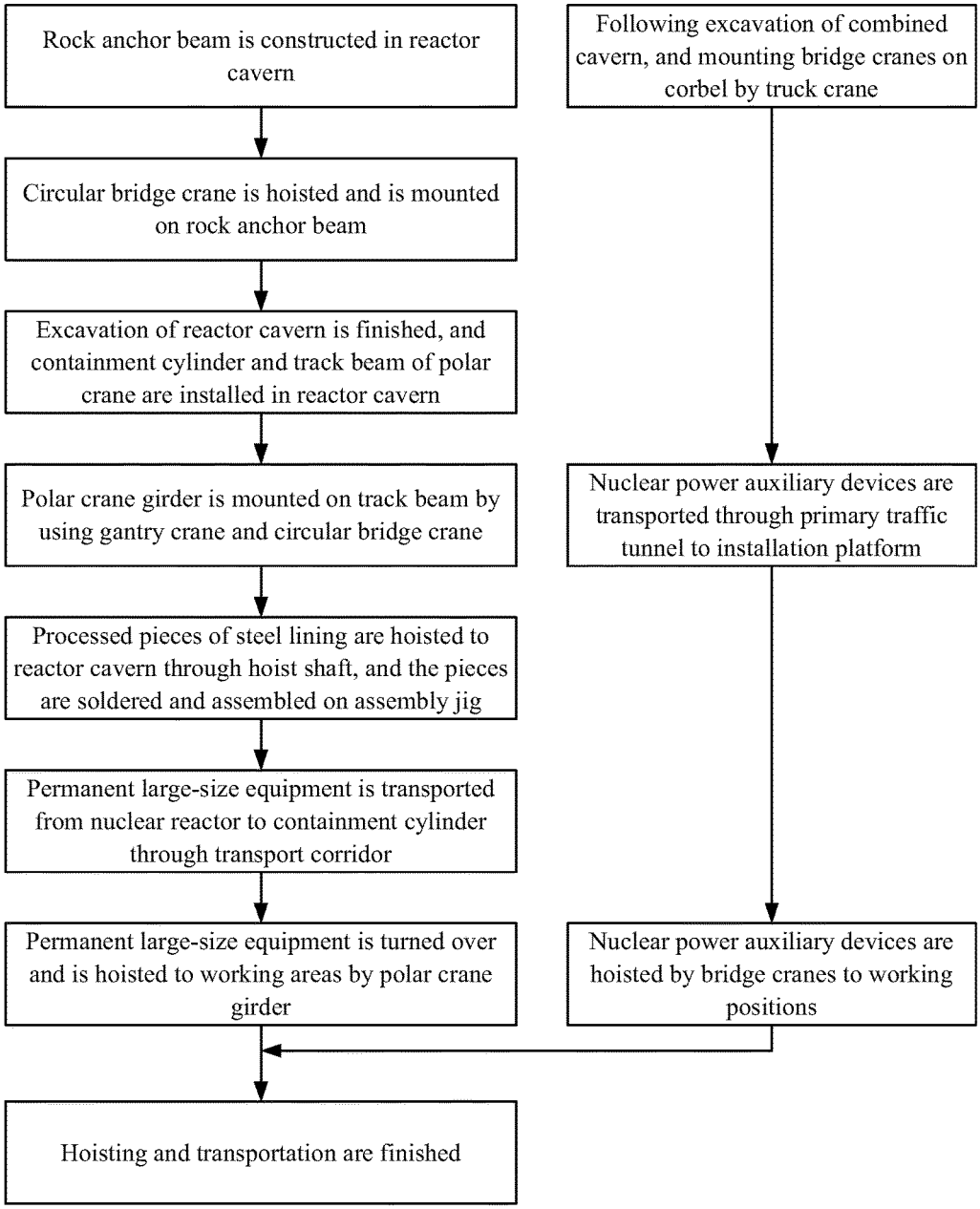
FIG. 4 is a flow chart of a method for hoisting and transporting assemblies in an underground nuclear power plant in accordance with one embodiment of the invention.

As shown in FIG. 4, the method for hoisting and transporting assemblies in an underground nuclear power plant comprises:

1) as shown in FIG. 1, when a rock anchor beam layer is yet to be constructed, concrete is poured onto a reactor cavern 1, and a rock anchor beam 15 is formed when the concrete reaches the age. A circular bridge crane 6 is hoisted to the reactor cavern 1 through a hoist shaft 2 on a top of the reactor cavern. The circular bridge crane 6 is mounted on the rock anchor beam 15 by using a truck crane; this is because the elevation of the reactor cavern 1 is high, if the circular bridge crane 6 is mounted when the construction of the reactor cavern 1 is completed, a relatively long arm of the truck crane is needed, however, existing arm of the truck crane is not long enough. In addition, even if the arm of the truck crane is long enough, the cylindrical reactor cavern 1 cannot accommodate such a long arm, thus the installation of the circular bridge crane is hard to implement. Therefore, the circular bridge crane 6 is installed right after the construction of the rock anchor beam is completed, which ensures a convenient operation even in a rather small space of the reactor cavern 1 using a normal arm of the track crane. Meanwhile, the hoist shaft 2 is arranged, so that the hoisting equipment on the ground is fully utilized, thus occupying less underground space.
2) The construction and the excavation of the reactor cavern 1 is continued. The containment cylinder 7 and the track beam 18 of a polar crane are installed in the reactor cavern using the circular bridge crane 6. The containment cylinder 7 and the track beam 18 are transported through the transport corridor 14. A gantry crane on one end of a polar crane girder 4 is hoisted, and the polar crane girder 4 is hoisted to the reactor cavern 1 through the hoist shaft 2. The other end of the polar crane girder 4 is hoisted using the circular bridge crane 6. The polar crane girder 4 is horizontal under a combined effect of the gantry crane and the circular bridge crane 6, and the polar crane girder is mounted on the track beam 18. Because the installation of the containment cylinder 7 is completed, it is difficult to transport the polar crane girder 4 through the transport corridor 14. While the steel lining 5 on the containment dome is not capped, hoisting the polar crane girder 4 to the reactor cavern 1 through the hoist shaft 2 is convenient; therefore, open upper space in the reactor cavern 1 is utilized, and the circular bridge crane 6 which is just installed is directly used, saving costs and time, and accelerating the construction progress.

3) The track beam 18 and the polar crane girder 4 are used as supporting points of an assembly jig of the steel lining 5 on a containment dome. Processed pieces of the steel lining 5 are hoisted to the reactor cavern 1 through the hoist shaft 2, and the pieces are soldered and assembled on the assembly jig. Unlike the above-ground nuclear power plant which has enough room for construction, the space in the reactor cavern 1 is limited, thus existing members are used as the supporting points, and the pieces of the steel lining 5 are soldered and assembled on the basis of the supporting points.

4) Permanent large-size equipment is transported from a nuclear reactor 3 to the containment cylinder 7 through a transport corridor 14 which is connected to the reactor cavern 1. The permanent large-size equipment is transported by a large-size platform lorry (not shown) along the track on the transport corridor 14 to an equipment gate (not shown) of the containment cylinder 7. The large-size permanent large-size equipment is transported to the containment cylinder 7 through the equipment gate, and is placed at the working platform (not shown) in the containment cylinder 7. The permanent large-size equipment is turned over and is hoisted to working areas by the polar crane girder 4. The permanent large-size equipment in the nuclear reactor 3 is installed after the steel lining 5 is capped, thus the hoist shaft 2 cannot be used for hoisting, and the hoisting and transportation of permanent large-size equipment are based on the transport channel 14 and the equipment gate and working platform in the containment cylinder 7.

Figure 2:
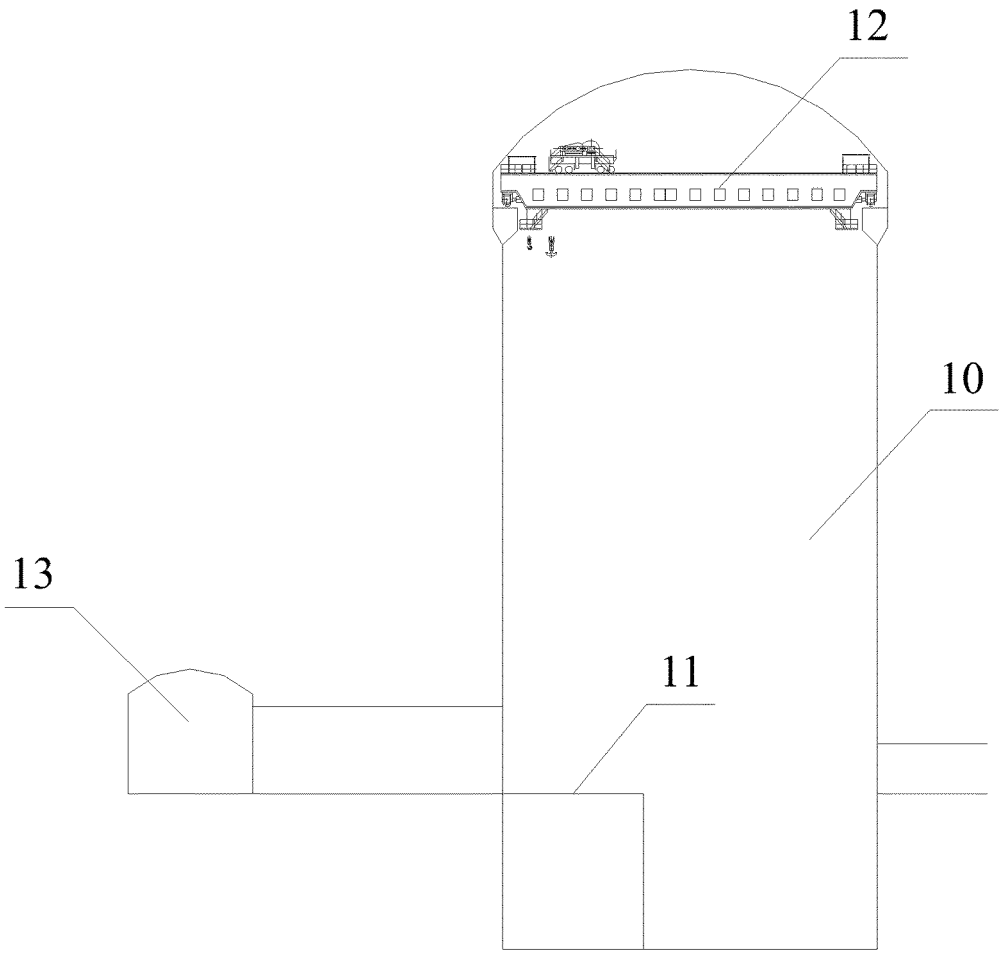
FIG. 2 is a schematic diagram showing that large-scale assemblies in other cavities of a nuclear island except the reactor cavern (taken a nuclear fuel powerhouse cavern as an example) are hoisted and transported using a method for hoisting and transporting assemblies in an underground nuclear power plant in accordance with one embodiment of the invention.

As shown in FIG. 2, the nuclear fuel powerhouse cavern 10 is taken as an example to illustrate step 5): the construction of the combined cavern, the electric powerhouse cavern 16, and the pressure relief cavern 17 is carried out. When an excavation of the combined cavern, the electric powerhouse cavern 16, and the pressure relief cavern 17 is completed, bridge cranes 12 are mounted on a corbel which is disposed lengthwise on an upper part of the combined cavern using the truck crane. Nuclear power auxiliary devices are transported through the primary traffic tunnel 13 to the installation platform 11 which is disposed at one side or one end of the combined cavern. The nuclear power auxiliary devices are hoisted by the bridge cranes 12 to working positions. The combined cavern is long lengthwise, and unlike the prior steps, the arm of the truck crane is not limited by the space in the reactor cavern 1, thus facilitating the installation and construction of the bridge cranes 12 using the truck crane.

The construction of 5) and the construction of 1), 2), 3), or 4) are simultaneously carried out, or the construction of 5) and the construction of 1), 2), 3), and 4) are simultaneously carried out.

The method fully utilizes existing devices in the large-size underground nuclear power plant, and combines the features of underground space and underground construction, so that the difficulty of hoisting and transporting large-scale assemblies in an underground nuclear power plant is solved, providing a new idea for the construction in the underground space.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method for hoisting and transporting assemblies in an underground nuclear power plant, the method comprising:

1) pouring concrete onto a reactor cavern to form a rock anchor beam disposed on an upper part of the reactor cavern; excavating a hoist shaft on a top portion of a reactor cavern in a direction perpendicular to the ground; hoisting a circular bridge crane to the reactor cavern through the hoist shaft; and mounting the circular bridge crane on the rock anchor beam;

2) installing a containment cylinder in the reactor cavern and installing a track beam of a polar crane on an upper part of the containment cylinder using the circular bridge crane; hoisting one end of a polar crane girder and sending the polar crane girder through the hoist shaft to the reactor cavern; hoisting the other end of the polar crane girder to be horizontal by the circular bridge crane; and mounting the polar crane girder on the track beam;

3) hoisting processed pieces of a steel lining to the reactor cavern through the hoist shaft; by using the track beam and the polar crane girder as supporting points, soldering and assembling the pieces of the steel lining on a top portion of the containment cylinder to form a containment dome;

4) transporting permanent equipment for a nuclear reactor into the containment cylinder through a transport corridor which is connected to the reactor cavern; and turning over the permanent equipment and hoisting the permanent equipment to working areas using the polar crane girder.

2. The method of claim 1, wherein when performing 1), excavating combined caverns; mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

3. The method of claim 1, wherein when performing 2), excavating combined caverns; mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

4. The method of claim 1, wherein when performing 3), excavating combined caverns; mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

5. The method of claim 1, wherein when performing 4), excavating combined caverns; mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

6. The method of claim 1, wherein when performing 1), 2), 3), and 4), excavating combined caverns; mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

7. The method of claim 1, further comprising: 5) excavating combined caverns, mounting bridge cranes on upper parts of the combined caverns, respectively; transporting nuclear power auxiliary devices through a primary traffic tunnel to installation platforms which are respectively disposed at one side or one end of the combined caverns; and hoisting the nuclear power auxiliary devices to working positions by the bridge cranes.

8. The method of claim 2, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the first second safe powerhouse cavern are connected in sequence; the auxiliary powerhouse cavern, the two safe powerhouse caverns, and the nuclear fuel powerhouse cavern each are connected to the primary traffic tunnel.

9. The method of claim 3, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the second safe powerhouse cavern are connected in sequence; the auxiliary powerhouse cavern, the two safe powerhouse caverns, and the nuclear fuel powerhouse cavern each are connected to the primary traffic tunnel.

10. The method of claim 4, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the second safe powerhouse cavern are connected in sequence; the auxiliary powerhouse cavern, the two safe powerhouse caverns, and the nuclear fuel powerhouse cavern each are connected to the primary traffic tunnel.

11. The method of claim 5, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the second safe powerhouse cavern are connected in sequence; the auxiliary powerhouse cavern, the two safe powerhouse caverns, and the nuclear fuel powerhouse cavern each are connected to the primary traffic tunnel.

12. The method of claim 6, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the second safe powerhouse cavern are connected in sequence; the auxiliary powerhouse cavern, the two safe powerhouse caverns, and the nuclear fuel powerhouse cavern each are connected to the primary traffic tunnel.

13. The method of claim 7, wherein the combined caverns comprise an auxiliary powerhouse cavern, two safe powerhouse caverns comprising a first powerhouse cavern and a second powerhouse cavern, and a nuclear fuel powerhouse cavern; the auxiliary powerhouse cavern, the two safe powerhouse caverns, and the nuclear fuel powerhouse cavern are disposed lengthwise in a line; the auxiliary powerhouse cavern, the first safe powerhouse cavern, the nuclear fuel powerhouse cavern and the second safe powerhouse cavern are connected in sequence; the auxiliary powerhouse cavern, the two safe powerhouse caverns, and the nuclear fuel powerhouse cavern each are connected to the primary traffic tunnel.

* * * * *